United States Patent [19]

Pfister

[11] 4,412,718

[45] Nov. 1, 1983

[54] ELECTRIC PLUG CONTACT AND METHOD FOR ITS MANUFACTURE

[75] Inventor: Max Pfister, Hunenberg, Switzerland

[73] Assignee: CDM Connectors Development & Mfg. AG, Cham, Switzerland

[21] Appl. No.: 349,862

[22] Filed: Feb. 18, 1982

Related U.S. Application Data

[62] Division of Ser. No. 189,845, Oct. 15, 1979, Pat. No. 4,341,434.

[30] Foreign Application Priority Data

Feb. 17, 1978 [CH] Switzerland ..... 1746/78

[51] Int. Cl.[3] ..... H01R 11/22; H01R 43/00

[52] U.S. Cl. ..... 339/256 R; 29/874; 29/508; 29/509

[58] Field of Search ..... 29/882, 876, 874, 505, 29/508, 509, 513, 515, 156.8 FC; 339/217 J, 256 R, 223 S, 217 S, 259 R

[56] References Cited

U.S. PATENT DOCUMENTS

| | | | |
|---|---|---|---|
| 2,360,383 | 10/1944 | Zeidler | 29/156.8 FC |
| 3,134,633 | 5/1964 | Hatfield | 339/217 J |
| 3,187,297 | 6/1965 | Gluntz . | |
| 3,335,397 | 8/1967 | Campbell, Jr. | 339/217 J |
| 3,364,459 | 1/1968 | Schiller | 339/259 R X |
| 3,445,930 | 5/1969 | Shlesinger, Jr. | 29/882 X |
| 3,467,944 | 9/1969 | Hammell et al. . | |
| 4,009,924 | 3/1977 | Bungo et al. | 339/223 S |
| 4,073,565 | 2/1978 | Raymond | 339/223 S |

FOREIGN PATENT DOCUMENTS

| | | |
|---|---|---|
| 444740 | 5/1927 | Fed. Rep. of Germany . |
| 511523 | 10/1968 | Fed. Rep. of Germany . |
| 2041065 | 2/1972 | Fed. Rep. of Germany . |
| 1132239 | 3/1957 | France . |
| 278735 | 2/1952 | Sweden . |
| 246700 | 2/1926 | United Kingdom . |

*Primary Examiner*—Gene Crosby
*Assistant Examiner*—Carl J. Arbes
*Attorney, Agent, or Firm*—Watson, Cole, Grindle & Watson

[57] ABSTRACT

In the case of a plug contact which consists of an electrical contact body (11) and of a spring sleeve (12) with a longitudinal joint (43), encompassing said contact body on the outside, the fixation of the spring sleeve on the contact body has been solved as follows: The portions of the spring sleeve (12) adjoining the longitudinal joint (43) each have a perforation (51) with which an anchoring cam (53) of the contact body (11) projecting to the outside is in locking engagement. Between each perforation (51) and the longitudinal joint (43), there is a hold back bridge (55) which, in cooperation with the adjacent anchoring cams (53), firmly holds the spring sleeve (12) tensed in flush contact along the periphery of a cylindrical portion of the contact body (11). For the manufacture of the plug contact, a sheet metal blank for the spring sleeve (12) is bent into a U-shape, the U-bridge and U-legs of which each run along a circular arc over about 120° and with a curvature adapted to the periphery of the contact body (11). The contact body (11) provided with the anchoring cams (53) is inserted into the U-shape in such a way that the anchoring cams (53) face away from the U-bridge. Then, the U-legs are forced laterally against the contact body (11), whereby the hold back bridges (55) are moved over the anchoring cams (53) and are brought into locking engagement with the latter.

5 Claims, 14 Drawing Figures

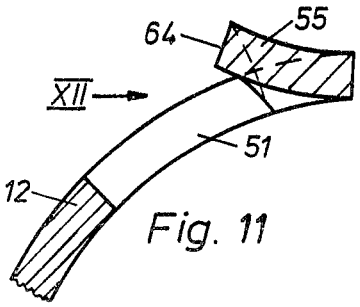
Fig. 11
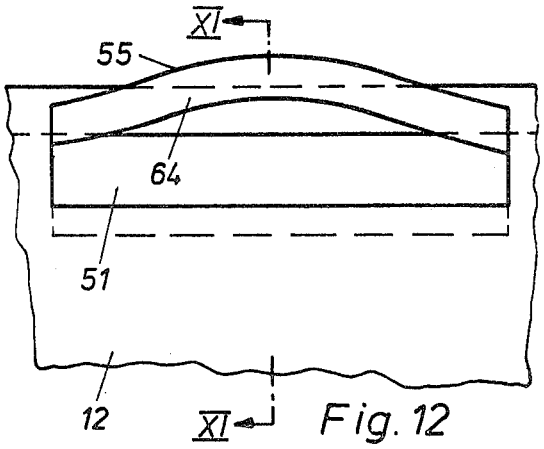
Fig. 12
Fig. 6
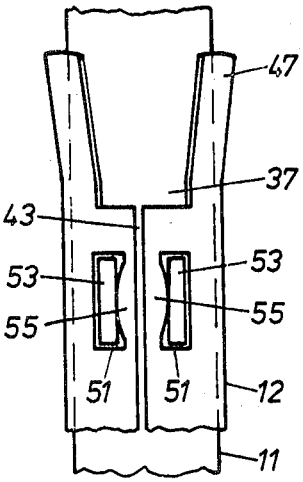
Fig. 7
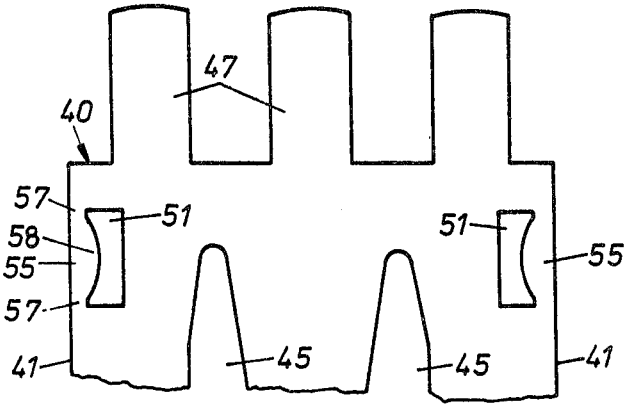
Fig. 13
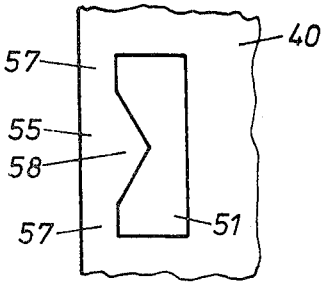
Fig. 14
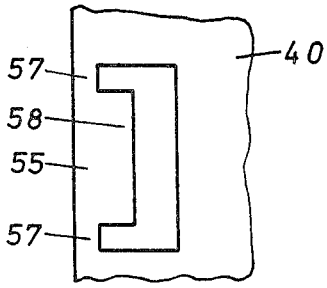

ELECTRIC PLUG CONTACT AND METHOD FOR ITS MANUFACTURE

This application is a divisional application of application Ser. No. 189,845, filed Oct. 15, 1979, now U.S. Pat. No. 4,341,434 issued July 27, 1982.

The present invention relates to an electric plug contact with an electrically conductive contact body, which has an essentially cylindrical part and with a spring sleeve encompassing the cylindrical part of the contact body, which sleeve is rolled in the form of a pipe from spring plate, and has a longitudinal joint, whereby the contact body and the spring sleeve are interconnected by recesses in the one of these parts and by projections at the other part engaging with said recesses. Furthermore, the invention relates to a method for the manufacture of such a plug contact.

Plug contacts of the type mentioned are known from the British Pat. No. 246 700 or the Swiss Pat. No. 511 523. The contact body of the plug contacts may be developed by selection as a plug pin or as a plug sleeve. Effectively, it consists of an electric contact material, such as brass, copper, bronze, and it guarantees a low electric volume resistivity and a relatively high current capacity. Because of the relatively low elasticity of the contact material, the contact body may be connected in a simple manner by a squeeze or crimping connection to an electric conductor. The spring sleeve serves several purposes. For one thing, it may be provided with thrust away tongues or flaps, which indeed permit the insertion of the plug contact into a housing of insulating material, but prevent the pulling back of the plug contact from the housing by striking against an inside shoulder of said housing. Furthermore, the spring sleeve may contribute to the prevention of the deformation of the contact body, especially whenever the latter is rolled in the manner of a pipe from sheet metal material and has a longitudinal joint. In the case of a contact body developed like a plug sleeve, which has contact tongues formed by longitudinal slits, the spring sleeve finally may also be provided for the purpose of preventing too strong an outward bending of the contact tongues and/or push the contact tongues resiliently toward the inside in order to bring about a higher contact pressure on a contact pin introduced into the plug sleeve.

In case of the hitherto known plug contacts of the initially mentioned type, the spring sleeve has been fixed on the contact body in that flaps formed on the spring sleeve engage with recesses of the contact body. This type of fixation is conditional on the fact that in the case of the production of the plug contact, the spring sleeve is held in its full contact on the periphery of the cylindrical part of the contact body, while the flaps are bent into the prepared recesses of the contact body. In order to make possible at all the bending of the flaps into the recesses of the contact body, the recesses in the direction transversely to the line of bending of the flaps must be considerably greater than the thickness of the metal sheet of the spring sleeve and as would be required by the terminal position of the flaps. From this follows an undesirable weakening of the contact body. In case that the plug contact is a plug sleeve, the type of fixation used hitherto has the additional disadvantage that the flaps of the spring sleeve must be relatively short, so that they would not project into the inside space of the contact body intended for the reception of a plug pin, wherefore the anchoring of the spring sleeve on the contact body is relatively uncertain, and in the case of use of the plug sleeve, the longitudinal joint of the spring sleeve may possibly burst open. This to be sure, could be avoided by interconnecting the parts of the spring sleeves themselves adjoining the longitudinal joint in a positive manner by making flaps on one portion of the sleeve engage with recesses in the other portion of the sleeve, and by bending them back. As a result of that however, the plug contact becomes more complicated and more expensive, and local enlargements of the outside dimensions of the spring sleeve develop in consequence of the superposed portions of the spring sleeve and of the flaps, which in some cases is a disadvantage.

In order to avoid the disadvantages of known embodiments, as described, it now is the task of the present invention to develop a plug contact of the initially mentioned type in such a way that a perfect connection will be guaranteed between the spring sleeve and the contact body without any flapshaped parts of the spring sleeve projecting into the inside of the contact body and without enlarging the outside diameters of the spring sleeve by superposed portions of said sleeve. Furthermore, the plug contact is to be developed such that a production be possible in a relatively simple and economic manner. Finally, it also constitutes the task of the invention of naming an effective, relatively simple and economic method for the production of the plug contact, by which process a safe fixation of the spring sleeve on the contact body is made possible.

This task is solved by the plug contact as defined in claim 1 and by the method for the production of the plug contact as defined in claim 8.

Advantageous embodiments of the plug contact of the invention and of the method for its production will result from the remaining claims.

The invention and its advantages are explained in more detail subsequently on the basis of embodiments with reference to the attached drawings.

FIG. 6 shows a portion of the plug contact as in FIG. 1 in view according to the arrow VI at a larger scale;

FIG. 7 represents a partial view of a flat sheet metal blank intended for the formation of the spring sleeve;

FIG. 11 shows a cross section following the line XI—XI in FIG. 12 through a portion of the spring sleeve;

FIG. 12 is a view of the same portion of the spring sleeve viewed in the direction of the arrow XII in FIG. 11;

FIGS. 13 and 14 each show a variation of the embodiment of the sheet metal blank for the spring sleeve.

Figure 1:
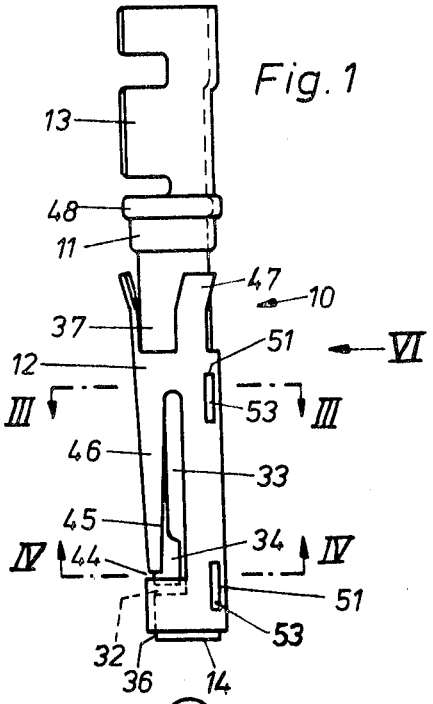
FIG. 1 shows an electric plug contact in side view, developed as a plug sleeve.

The electric plug socket 10, shown in FIG. 1, consists of an essentially pipeshaped contact body 11 made of electrically well conductive contact material, f. ex., brass, copper or bronze, and of a spring sleeve 112 made of spring plate, surrounding the contact body 11 on the outside. The one end portion of the contact body 11 is developed as a connecting terminal 13, U-shaped in its cross section for insertion of an electric conductor (not shown) which may be connected mechanically and electrically, f.ex., by crimping the connecting terminal 13, with the contact body 11. The opposite end of the contact body 11 has a mouth 14 for the introduction of the plug pin according to FIG. 2. Details of the plug sleeve 10 are explained further below.

Figure 2:
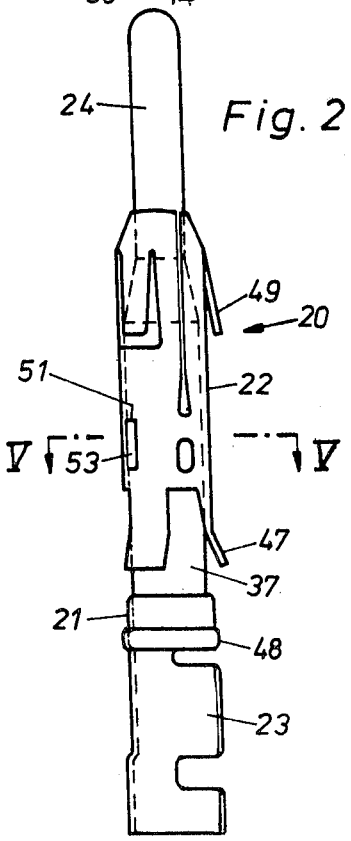
FIG. 2 is an analogous illustration of an electric plug contact developed as a plug pin.

The electric plug pin 20 shown in FIG. 2, consists of a contact body 21, of electrically well conductive material and of a spring sleeve 22 made of spring plate surrounding the contact body 21 on the outside. The one end portion of the contact body 21 is developed as a connecting terminal 23 for insertion of an electric conductor (not shown) which, f. ex., may be connected mechanically and electrically with the contact body 21 by squeezing the connecting terminal 23. The other end portion of the contact body 21 is developed as a contact pin 24 which may be introduced through the aperture 14 into the plug sleeve 10. Details of the plug pin 20 will be described later on.

Now let us first explain the development of the plug sleeve 10 in more detail. The contact body 11 is rolled from sheet metal and has a longitudinal joint 31, where the opposite cutting edges of the sheet metal abut flush, as one can recognize clearly in FIGS. 3 and 4. The contact body 11 has a transverse slit 32 and two longitudinal slits 33 which are disposed symmetrically in relation to the longitudinal joint 31 and form together with the longitudinal joint 31, two contact fingers 34 running side by side, which extend in the longitudinal direction of the contact body 11 and which are resilient radially in relation to the longitudinal axis of the contact body 11. Furthermore, the two longitudinal slits 33 are disposed in such a way that a part 35 of the contact body is opposite the two contact fingers 34 which part (35) extends over about half the periphery of the contact body 11 and thus is radially practically inflexible. The cutting edges of the part 35 of the contact body adjoining the longitudinal slits 33 each constitute a stop for the free end portion of one or of the other contact finger 34 in order to limit the mobility of the contact fingers to the inside. Between the end of the contact body 11 having the aperture 14 and the cross slit 32, said contact body has a cylindrical portion 36 closed along the entire circumference. An analogous cylindrical portion 37 of the contact body 11 is located at the opposite end of the longitudinal slits 33.

Figure 3:
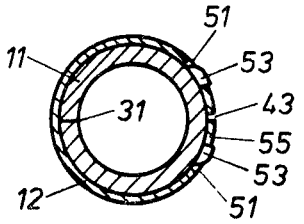
FIG. 3 illustrates at a larger scale a cross section following the line III—III in FIG. 1.
Figure 4:
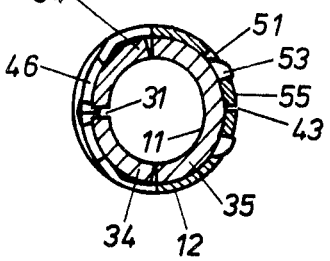
FIG. 4 shows an analogous cross section following line IV—IV in FIG. 1.

The spring sleeve 12 is rolled in the manner of a pipe from a blank 40 of a spring plate (FIG. 7), so that the opposite cutting edges 41 of the sheet metal blank are opposite one another and a longitudinal joint 43 is formed on the spring sleeve between said cutting edges, as FIGS. 3, 4 and 6 show clearly. The longitudinal joint 43 of the spring sleeve 12 lies diametrically opposed to the longitudinal joint 31 of the contact body 11, as FIGS. 3 and 4 show clearly. The spring sleeve 12 has a cross slit 44 and two longitudinal slits 45 starting out from the former, in order to form a tongue 46 which is diametrically opposed to the longitudinal joint 43 and which is shaped such that under the influence of its elasticity it exerts a pressure on the contact fingers 34 of the contact body 11 in order to force said fingers toward the inside. The end of the spring sleeve 12 facing away from the aperture 14 of the contact body 11 has several locking flaps 47 which are thrust away from the contact body 11 and which, together with an outside bulge 48 of the contact body, serve for the purpose of holding the plug sleeve 10 firmly in a housing from insulating material (not shown), as is familiar to the expert.

In order to fixate the spring sleeve 12 on the contact body 11 against twisting and against axial shifting, the following means and measures have been provided: According to the FIGS. 1, 3, 4 and 6, the spring sleeve 12 on each of its portions adjoining the longitudinal joint 43 and lying within the area of the cylindrical portions 36 and 37 of the contact body, has a perforation 51, with which an anchoring cam 53 of the contact body 11 is in locking engagement. The anchoring cams 53 are located on the side of the contact body facing away from the longitudinal joint 31 of the contact body 11. The perforations 51 are each disposed at a distance from the adjacent cutting edge 1 (FIG. 7) of the sheet metal blank 40 forming the spring sleeve 12, so that there is a hold back bridge 55 of sufficient strength between each perforation 51 and the longitudinal joint 43 of the spring sleeve. These hold back bridges 55 of the spring sleeve 12 and the flanks of the anchoring cams 53 of the contact body 11 facing the longitudinal joint 43 are in contact and together bring about the fact that the spring sleeve 12 is held tensed flush around the periphery of the cylindrical portions 36 or 37 of the contact body 11 and as a result of that is secured against twisting in relation to the contact body. The dimensions of the perforations 51 as well as of the anchoring cams 53 agree approximately in the direction parallel to the longitudinal axis of the plug sleeve 10, as a result of which the spring sleeve 12 is secured even against axial shifting on the contact body 11. Preferably, the perforations 51 and the anchoring cams 53 are disposed symmetrically in relation to a plane which contains the longitudinal axis of the plug sleeve 10 and which passes through the middle of the longitudinal joint 43 of the spring sleeve 12.

Figure 8:
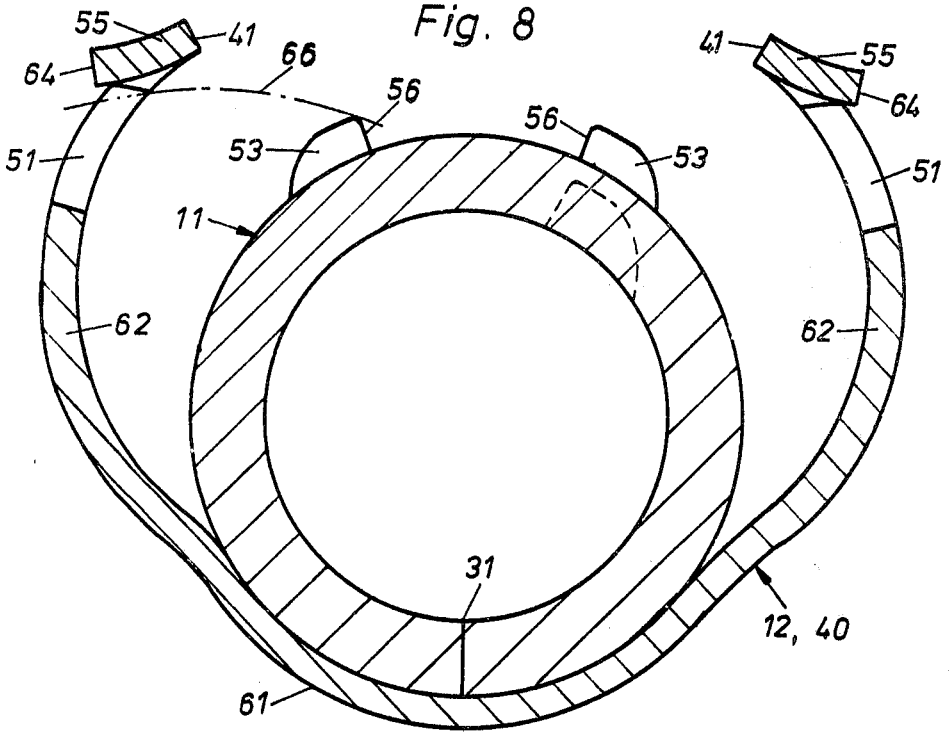
FIGS. 8, 9 and 10 are illustrations in cross section which illustrate various phases of the method for the production of the plug contact.
Figure 10:
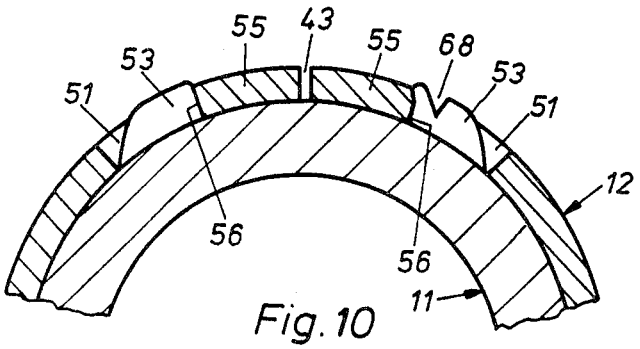

The fixation of the spring sleeve 12 on the contact body 11 is particularly good, whenever the flanks 56 facing the longitudinal joint 43 of the spring sleeve each run approximately in a plane which contains the longitudinal axis of the cylindrical portion 36 or 37 of the contact body and stands radially in relation to the cylindrical portion, as shown most clearly in the FIGS. 8 and 10. For a reason which still will have to be explained, it is of advantage furthermore to assign a lesser width in the circumferential direction of the spring sleeve according to FIG. 7 to each hold back bridge 55 of the spring sleeve 12 at its axial end portions 57, than in its middle portion 58, so that only the latter will be in contact with the associated anchoring cam 53, as FIG. 6 shows. The dimension in height of each anchoring cam is only slightly greater than the thickness of the spring plate forming the spring sleeve 12.

The production of the plug sleeve 10, as described, is accomplished effectively according to the following method:

The contact body 11 with the anchoring cams 53 is prefabricated as a one-part workpiece by rolling a properly cut blank of sheet metal in a manner known per se and the anchoring cams 53 are forced from the direction of the side lying inside on the finished contact body to the outside, preferably in an intermediate phase, with the help of a stamping matrix (not shown) and a press die marching it.

For the formation of the spring sleeve 12, the flat blank of the spring plate 40 (FIG. 7) is prepared, which at opposite edge portions, is provided with the perforations 51 and the hold back bridges 55. The prepared blank 40 of the sheet metal is bent first of all into a U-shape which, according to FIG. 8, consists of a medium U-bridge 61 and two lateral U-arms 62. Both the U-bridge 61 as well as each of the lateral U-arms 62, viewed in its cross section, runs along a circular arc which extends over about 120° and which is adapted to the curvature of the peripheral surface of the cylindrical portions 36 and 37 of the contact body 11. In the above mentioned U-shape, the opposite edges 41 of the blank 40 of the sheet metal have a distance from one another which is about equal to the outside diameter of the contact body 11. During the formation of the above described U-shape, each of the hold back bridges 55 is twisted such that its lateral edge 64 adjacent to the perforation 51 and facing away from the lateral edge 41 of the blank 40 of the sheet metal, comes to lie further to the outside than the remaining part of the pertinent U-arm 62 containing the perforation 51, as can be seen clearly in FIGS. 8, 11 and 12. This twist of the hold back bridge 55 has been favored by the fact that the width of each hold back bridge in its axial end portion 57 is smaller than it is in its middle portion 58. Thus, above all, the lateral edge 64 of the middle portion 58 is the one which is displaced to the outside.

Figure 9:
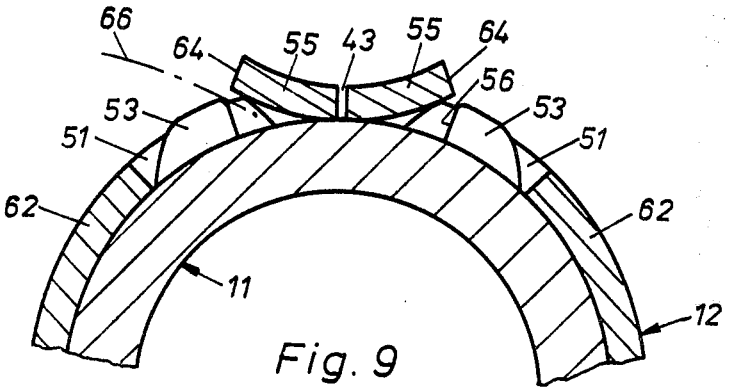

The prefabricated contact body 11 is inserted right through between the U-legs 62 into the U-form of the blank 40 of the metal sheet formed in the manner described, whereby the portion of the contact body 11 having the longitudinal joint 31 is brought into contact with the U-bridge 61. The anchoring cams 53 of the contact piece 11 at the same time face away from the U-bridge 61. Subsequently, the two U-legs 62 are swivelled up laterally to the contact body 11 for the purpose of finishing the spring sleeve 12. By this operation, the lateral edges 64 of the hold back bridges displaced to the outside by the twist of the hold back bridges 55, viewed in the cross section according to FIG. 8, move approximately along circular arcs 66 just barely over the anchoring cams 53 of the contact body 11. When the U-legs 62 have been brought completely into contact with the contact body 11, as FIG. 9 shows, the originally opposite lateral edges 41 of the blank 40 of sheet metal are opposite each other in order to form the longitudinal joint 43 of the spring sleeve 12 and the anchoring cams 53 are within the associated perforations 51. Whereas the U-legs 62 further remain forced laterally against the contact body 11, the twisted hold back bridges 55 are subsequently forced back into their original form and are made to fit against the contact body 11. At the same time, the lateral edges 64 of the hold back bridges 55, previously displaced to the outside, come into locking engagement with the radially running flanks 56 of the anchoring cams, as illustrated in the left half of FIG. 10. By this operation, the lateral edges 64 of the hold back bridges 55 are wedged together with the flanks 56 of the anchoring cams 53 so that the spring sleeve 12 is held flush against the contact body when ever finally the lateral pressure on the U-legs 62 is released.

Although by the method described, a sufficiently firm seat of the spring sleeve 12 on the contact body 11 may be achieved, a recess 68 (FIG. 10, right half) may be put additionally into individual or all anchoring cams 52 by driving a calking tool into the pertinent anchoring cam. As a result of that the flank 56 of the anchoring cam is pushed in the direction toward the longitudinal joint 43 against the hold back bridge 55 and the spring sleeve is tightened even more around the contact body 11.

According to FIGS. 6 and 7, the lateral edge of the middle portion 58 of each perforation 51 cooperating with the radial flank 56 of the anchoring cam 53 is approximately circularly arched. However other types of embodiments are also possible, as illustrated pruely by way of example in the FIGS. 13 and 14.

Figure 5:
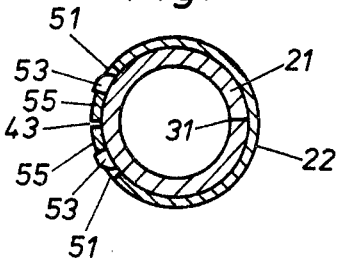
FIG. 5 is an analogous illustration of a cross section following the line V—V in FIG. 2.

Now let us still explain in more detail the development of the plug pin 20 according to FIGS. 2 and 5. The contact body 21 is rolled from sheet metal and, just like the contact body 11 of the plug sleeve 10, has a longitudinal joint 31 (FIG. 5). The spring sleeve 22 encircling the contact body 21 is rolled from a blank of spring plate (not separately shown) and like the spring sleeve 12 of the contact sleeve 10, has a longitudinal joint 43 (FIG. 5), which lies diametrically opposite the longitudinal joint 31 of the contact body 21. The end portion of the spring sleeve 22 facing away from the contact pin 24 forms several locking flaps 47, which are spread away from the contact body 21 and serve in a known manner, together with an outside bead 48 of the contact body, for holding the plug pin 20 firmly in a housing of insulating material (not shown). At the other end portion of the spring sleeve 22, there are several spring tongues 49 spread to the outside which serve for centering the contact pin in regard to a recess of the above mentioned housing of insulating material, accommodating the plug pin 20.

The spring sleeve 22 is fixated on the contact body 21 in an analogous manner as the spring sleeve 12 on the contact body 11. The portions of the spring sleeve 22 adjacent to the longitudinal joint 43 each have a perforation 51 with each of which one anchoring cam 53 of the contact body 21 is in locking engagement, as shown most clearly in FIG. 5. A hold back bridge 55 is disposed between each perforation 51 and the longitudinal joint 43, which bridge in cooperation with the pertinent anchoring cam 53, holds the spring sleeve 22 tensed around the circumference of a cylindrical portion 37 of the contact body 21. Shape and arrangement of the perforations 51 and of the anchoring cams 53 are in detail exactly as has been described exhaustively with reference to the plug sleeve 10. Likewise, the method for the production of the plug pin 20 is completely analogous to the method described above for the production of the plug sleeve 10, and therefore no further explanations are needed.

The plug contacts 10 and 20, as described and as compared to known embodiments, do have the advantage that the spring sleeve 12 or 22 is fixated perfectly on the contact body 11 or 21 by the perforations 51 of the spring sleeve and the anchoring cams 53 of the contact body 11 or 21 reaching into the perforations 51. It is also of advantage that none of the parts serving for fixating project into the inside of the contact body 11 or 21, or project noticeably beyond the periphery of the spring sleeve 12 or 22 to the outside. An essential advantage furthermore is the fact that the production method described is relatively simple and leads safely to perfect plug contacts. As a result of the twisting of the hold back bridge 55, as described, during forming the U-shape 61, 62 of the blank of the spring plate, the advantage results that in the subsequent operation of laterally pressing the U-legs 62 against the contact body 11 or 21, the hold back bridges 55 may be moved easily over the anchoring cams 53. However, a variation of the method is also possible, in the case of which the twisting of the hold back bridges 55 is omitted and the latter are simply forced over the anchoring cams 53 during the lateral pressure of the U-legs 62 against the contact body 11 or 21, whereby a temporary elastic or partly elastic deformation of the hold back bridges 55 takes place and they finally snap behind the anchoring cams. By wedging the anchoring cams 53 after the latter have been brought into engagement with the perforations 51 of the spring sleeve 12 or 22, it is possible to achieve an even firmer seat of the spring sleeve on the contact body 11 or 21 in a simple manner.

What is claimed is:

1. A method of fabricating an electric plug contact which comprises the steps of (a) providing a prefabricated, elongated, electrically conductive contact body which has a cylindrical portion that includes at least one pair of anchoring members extending outwardly thereof, (b) providing an elongated, flat sheet metal blank which includes generally parallel side edges and pairs of perforations therein at least equal in number to the number of pairs of anchoring members on the contact body, each perforation of each pair of perforations being located near an opposite side edge of the sheet metal blank so as to create a holding bridge portion between each perforation and an associated side edge, each perforation being suitably located and shaped to be engagable by a separate anchoring member, (c) bending the elongated, flat sheet metal blank into a generally U-shaped configuration, the U-shaped configuration including a middle part and two lateral leg parts, the middle part and the two leg parts, when viewed in cross section, each extending along a circular arc which extends over about 120° and are adaptable to conform to the outer surface of the cylindrical portion of the contact body, (d) placing the contact body between the leg parts of the generally U-shaped sheet metal blank and such that it contacts the middle part, the contact body being oriented such that the anchoring members extending outwardly thereof are on the side opposite the side in contact with the middle part of the generally U-shaped sheet metal blank, (e) bending the leg parts of the generally U-shaped sheet metal blank towards the outer surface of the cylindrical portion of the contact body until the side edges thereof are closely positioned and the perforations therein enclose the anchoring members of the contact body, each anchoring member contacting an associated holding bridge of the bent sheet of metal blank.

2. The method of fabricating an electric plug contact as defined in claim 1 wherein each holding portion of the flat sheet metal blank is similarly bent out of the plane defined by the flat sheet metal blank, wherein in step (c) the sheet metal blank is bent such that the holding portions thereof extend outwardly of the produced generally U-shaped configuration, and wherein the method includes as step (f) bending each of the holding portions towards the outer surface of the contact body so as to wedge each holding portion against the anchoring member located in the associated perforation.

3. The method of fabricating an electric plug contact as defined in claim 1 wherein the method includes as step (d) driving the end of a tool into the top of each anchoring member to provide an indentation therein and cause the anchoring member to be wedged with greater force against the associated holding bridge of the sheet metal blank.

4. The method of fabricating an electric plug contact as defined in claim 1 wherein said prefabricated, elongated, electrically conductive contact body is by rolling a flat piece of sheet metal into a cylindrical shape and then outwardly punching portions of the rolled sheet metal from the interior thereof so as to form the anchoring members.

5. An electric plug contact which has been formed by the method of claim 1.

* * * * *